US007042477B2

(12) United States Patent
Yoshida et al.

(10) Patent No.: US 7,042,477 B2
(45) Date of Patent: May 9, 2006

(54) PHOTO PRINTER

(75) Inventors: Yuichi Yoshida, Daito (JP); Masami Shiratori, Daito (JP)

(73) Assignee: Funai Electric Co., Ltd., Daito-shi (JP)

( * ) Notice: Subject to any disclaimer, the term of this patent is extended or adjusted under 35 U.S.C. 154(b) by 0 days.

(21) Appl. No.: 10/869,835

(22) Filed: Jun. 18, 2004

(65) Prior Publication Data

US 2004/0257426 A1 Dec. 23, 2004

(30) Foreign Application Priority Data

Jun. 19, 2003 (JP) ..... 2003-174492

(51) Int. Cl.
*B41J 2/32* (2006.01)

(52) U.S. Cl. ..... 347/175; 347/212

(58) Field of Classification Search ..... None
See application file for complete search history.

(56) References Cited

U.S. PATENT DOCUMENTS 5,629,729 A * 5/1997 Fujishiro ..... 347/175
5,745,151 A * 4/1998 Fujishiro ..... 347/212
5,825,396 A * 10/1998 Fujishiro ..... 347/212
6,084,624 A * 7/2000 Yamakawa ..... 347/175

FOREIGN PATENT DOCUMENTS

JP 10-29328 2/1998
JP 2001-239687 9/2001

* cited by examiner

*Primary Examiner*—Huan Tran
(74) *Attorney, Agent, or Firm*—Crowell & Moring LLP

(57) ABSTRACT

When a drive force of the motor for feeding the rolled paper is exerted on a shutter, the shutter moves. When fixing an image formed on a heat-sensitive yellow color developing layer, the shutter is positioned above yellow fixing lamps and the movement of the shutter is restricted by a locking member. When the rolled paper is retracted into a main body of the photoprinter, and a rear end of an image forming area of this time is located in the vicinity of the distal end of the shutter, restriction of the shutter by the locking member is released and the shutter is moved synchronously with the rolled paper.

5 Claims, 7 Drawing Sheets

PHOTO PRINTER

BACKGROUND OF THE INVENTION

1. Field of the Invention

The present invention relates to a photo printer for forming a color image on a rolled paper on which heat-sensitive color developing layers of yellow, magenta, and cyan are formed.

2. Description of the Related Art

In the relate art, there was a photo printer for forming a color image on a rolled paper on which heat-sensitive color developing layers of yellow, magenta, and cyan are formed. A general photo printer forms a color image by performing a series of procedures described below from (1) to (6) as shown in Patent Documents 1 and 2. The respective procedures in (1) to (6) are performed for an image forming area on which a color image of this time is formed while feeding or retracting the rolled paper.

(1) Perform heat-sensitive printing on a heat-sensitive yellow color developing layer to form an yellow image;

(2) Perform exposure using an yellow fixing lamp to fix the yellow image;

(3) Perform heat-sensitive printing on a heat-sensitive magenta color developing layer to form a magenta image;

(4) Perform exposure using a magenta fixing lamp to fix the magenta image;

(5) Perform heat-sensitive printing on a heat-sensitive cyan color developing layer to form a cyan image;

(6) Cut the image formed area off the rolled paper and discharge the same.

The cyan image is fixed by being exposed by an ultraviolet ray contained in natural light.

The photo printer is provided with a shutter, which is shown in JP-A-10-29328 and JP-A-2001-239687, for reducing a no image forming area which is exposed by the fixing lamp in the vicinity of the boundary between the portion where the image is to be formed this time (image forming area) and the portion where no image is to be formed (no image forming area). Since the no image forming area which is exposed by the fixing lamp cannot be used for the next image formation and hence is wasted, the shutter is provided for reducing the portion to be wasted, and utilizing the rolled paper effectively. More specifically, the shutter covers the no image forming area when the portion in the vicinity of the boundary between the image forming area and the no image forming area is transported through the position to be exposed by the fixing lamp, so as to prevent the no image forming area from being exposed.

However, the photo printer shown in JP-A-10-29328 has a structure in which the shutter is moved by a drive force of a feeding motor for feeding the rolled paper, and is provided with a electromagnetic clutch for switching between a state in which the drive force of the feeding motor is transmitted to the shutter to start the movement of the shutter and a state in which the drive force is not transmitted thereto when the shutter reaches an adequate position with respect to the rolled paper being fed, that is, the position to cover the no image forming area from the position in the vicinity of the boundary between the image forming area and the no image forming area for performing exposure by the fixing lamp. The drive force of the feeding motor is transmitted to the shutter via a plurality of gears. The electromagnetic clutch is provided in the gear group. Therefore, the structure of the gear group for transmitting the drive force of the feeding motor to the shutter is complicated, and a device body is expensive.

On the other hand, since the photo printer disclosed in JP-A-2001-239687 is provided with a motor for moving the shutter and a motor for feeding the rolled paper separately, it is not necessary to provide the electromagnetic clutch for moving the shutter, and hence the structure of the gear group may be simplified. However, since the two motors are provided, there arises a problem in that the device body is upsized, and hence the cost is increased.

SUMMARY OF THE INVENTION

It is an object of the present invention to provide a photo printer in which the gear structure for transmitting the drive force of the motor for feeding the rolled paper to the shutter is simplified and the cost reduction of the device body is achieved.

The photo printer of the invention has a following structure.

(1) A photo printer including:

a feeding device for feeding a rolled paper on which heat-sensitive color developing layers for yellow, magenta, and cyan are formed by a feeding motor;

a thermal head for changing the heat-sensitive temperature for each heat-sensitive color developing layer of the rolled paper which is fed by the feeding device, performing heat-sensitive recording and forming an image;

a magenta fixing lamp for fixing an image formed by the thermal head on the heat-sensitive magenta color developing layer;

an yellow fixing lamp for fixing an image formed by the thermal head on the heat-sensitive yellow color developing layer;

the thermal head, the magenta fixing lamp, the yellow fixing lamp being disposed in this order in the paper discharging direction;

a shutter disposed between the yellow and magenta fixing lamps and the rolled paper so as to be movable for limiting the area of the rolled paper to be exposed;

a shutter moving device for transmitting a drive force of the feeding motor to the shutter and moving the shutter in the same direction as the feeding direction of the rolled paper;

the shutter being positioned above the yellow fixing lamp when fixing the image formed on the heat-sensitive yellow color developing layer and being moved together with the rolled paper when the rolled paper is retracted to a main body and the rear end of an image forming area of this time is positioned in the vicinity of the distal end of the shutter; and a movement locking device for restricting the shutter from moving when the drive force to move the shutter in the direction from the yellow fixing lamp toward the magenta fixing lamp is transmitted to the shutter by the shutter moving device in a first state in which the shutter is positioned above the yellow fixing lamp.

In this arrangement, the drive force of the motor for feeding the rolled paper is transmitted to the shutter, and hence the shutter is moved. In the first state in which the shutter is positioned above the yellow fixing lamp, the movement of the shutter can be restricted by the movement locking device even when the drive force to move the shutter in the direction from the yellow fixing lamp toward the magenta fixing lamp is transmitted to the shutter. Therefore, when fixing the image formed on the heat-sensitive yellow color developing layer, the shutter is positioned above the yellow fixing lamp, the movement of the shutter is restricted by the movement locking device, and the rolled paper is retracted into the main body. Then, the movement of the shutter is continuously restricted until the rear end of the image forming area of this time is positioned in the vicinity of the distal end of the shutter. Subsequently, when the rear end of the image forming area of this time is positioned in the vicinity of the distal end of the shutter, restriction of the movement of the shutter by the movement locking device is released so that the shutter is allowed to move together with the rolled paper.

Therefore, it is not necessary to provide the magnetic clutch or the like for the gear group, which transmits the drive force of the feeding motor for feeding the rolled paper to the shutter, and hence the structure of the gear group for transmitting the drive force of the motor for feeding the rolled paper to the shutter may be simplified, whereby cost reduction of the main body is achieved.

(2) A photo printer including cutting device disposed between the thermal head and the magenta fixing lamp for moving a cutting edge of a cutter widthwise of the rolled paper to cut the rolled paper, and a movement locking device is switched into the locking state in which the movement of the shutter is restricted when the position of the cutting edge of the cutting device is at a specific position, and is switched into the unlocking state when the cutting edge is other positions.

In this arrangement, by moving the cutting edge for cutting the rolled paper, the locking state in which the movement of the shutter effected by the movement locking device is restricted and the unlocking state in which the movement thereof is not restricted.

(3) A photo printer including a stopper for limiting the range of the movement of the shutter.

In this arrangement, the shutter is prevented from being excessively transferred.

BRIEF DESCRIPTION OF THE DRAWINGS

These and other objects and advantages of this invention will become more fully apparent from the following detailed description taken with the accompanying drawings in which.

DESCRIPTION OF THE PREFERRED EMBODIMENTS

A photo printer according to an embodiment of the present invention will be described below.

Figure 1A:
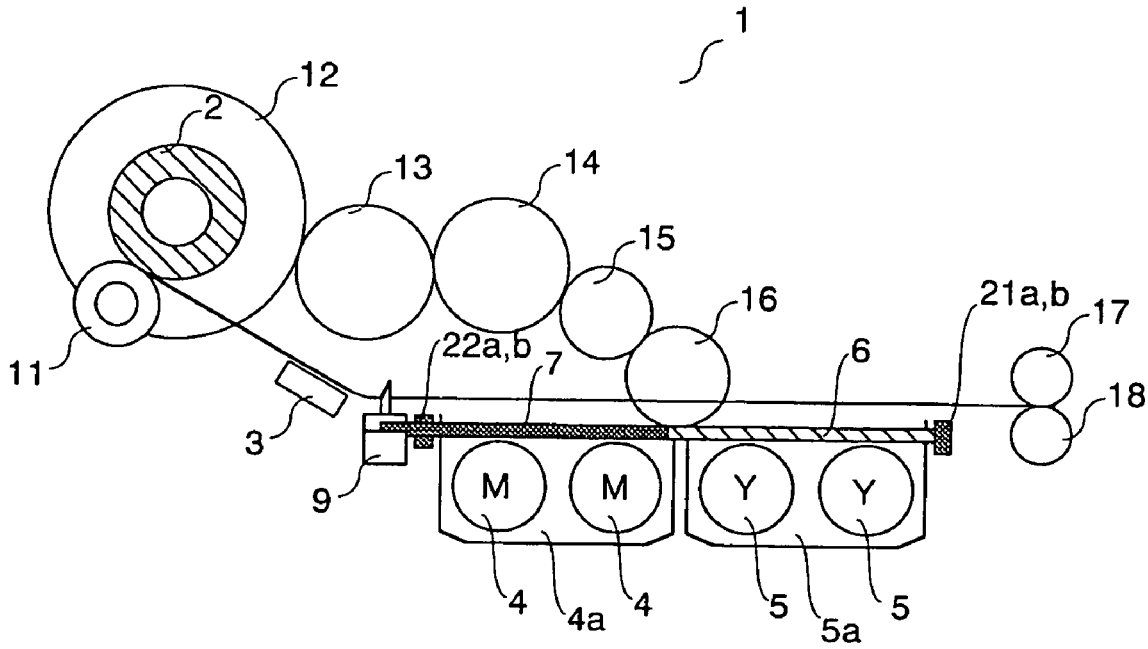
FIGS. 1A and 1B show a structure of a principal portion of a photo printer according to an embodiment of the present invention.
Figure 1B:
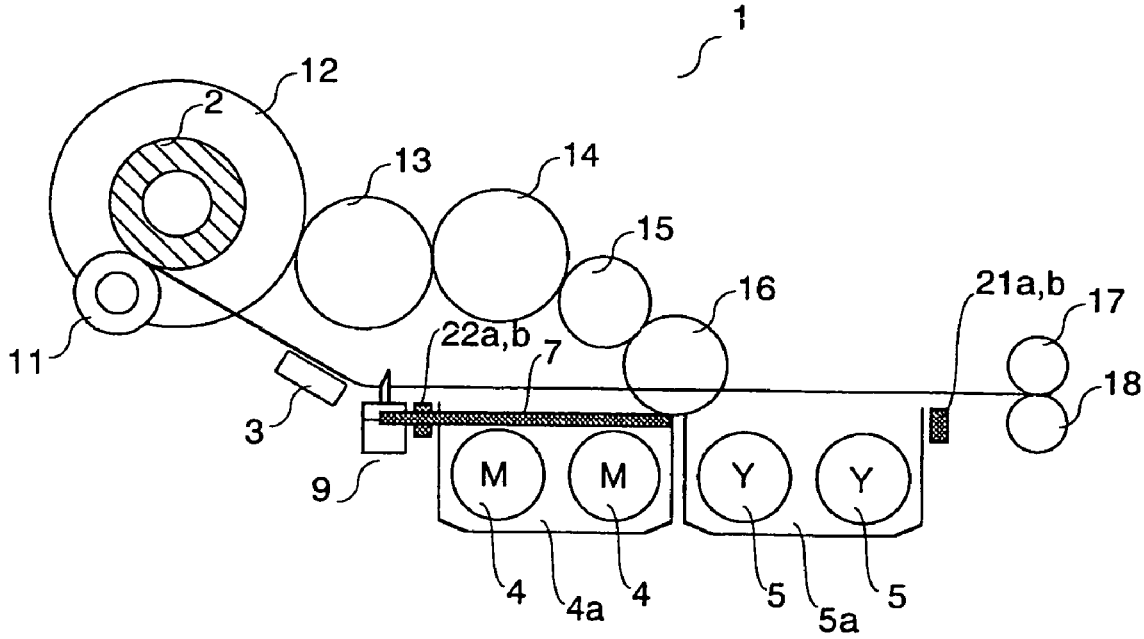

FIG. 1 is a drawing showing a principal portion of a photo printer according to an embodiment of the present invention. FIG. 1A shows a state in which a shutter is locked, and FIG. 1B shows a state in which the shutter is not locked. In FIGS. 1A and 1B, reference numeral 1 designates a photo printer body, and reference numeral 2 designates a rolled paper. The rolled paper 2 is formed with heat-sensitive color developing layers of yellow, magenta, and cyan. Reference numeral 3 designates a thermal head for performing heat-sensitive recording by changing the heat-sensitive temperature for each of heat-sensitive color generating layers of yellow, magenta, and cyan on the rolled paper 2, reference numeral 4 designates a magenta fixing lamp for fixing an image formed on the heat-sensitive magenta color generating layer, reference numeral 5 designates a yellow fixing lamp for fixing an image formed on the heat-sensitive yellow color generating layer. The magenta fixing lamps 4 and the yellow fixing lamps 5 are stored in reflectors 4*a*, 5*a* which surround the lower surface and the side surface respectively. Reference numeral 6 designates a shutter which has an enough size to cover the entire upper surface of one of the reflectors 4*a*, 5*a*.

Figure 2A:
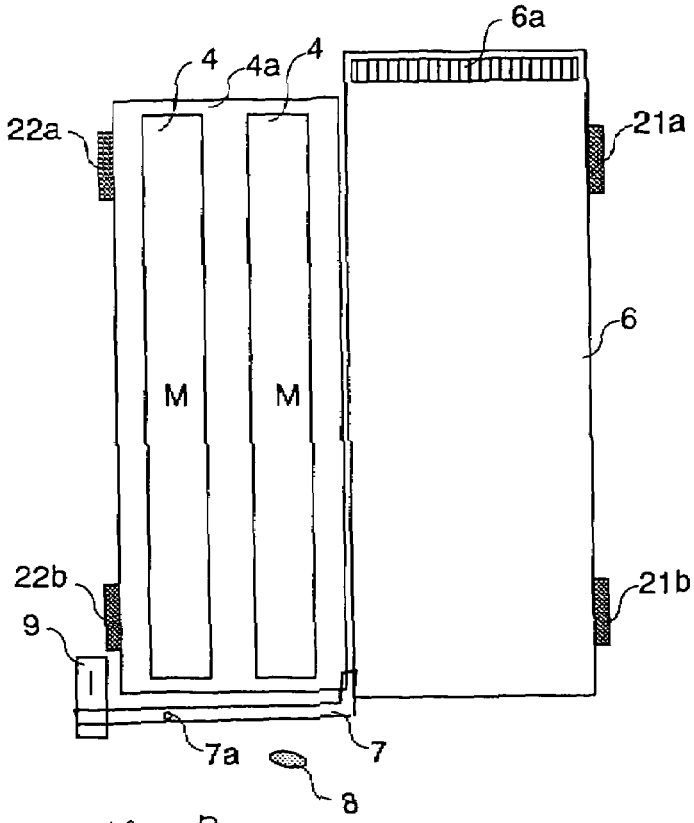
FIGS. 2A and 2B are top views of an area around reflectors in which a magenta fixing lamp and an yellow fixing lamp are stored in the photo printer according to the embodiment of the present invention.
Figure 2B:
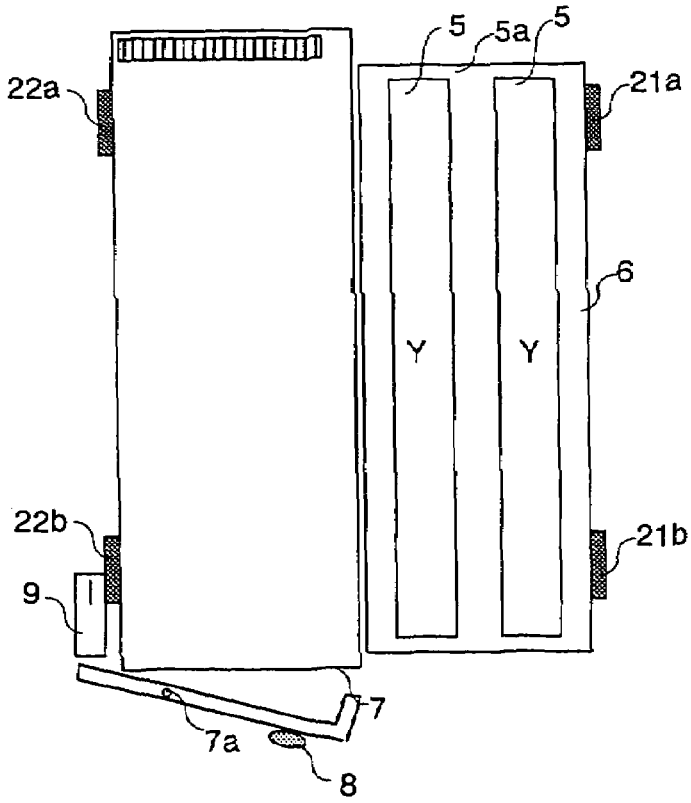

FIGS. 2A, 2B, and 2C are top views of the area around the reflectors in which the magenta fixing lamp and the yellow fixing lamp are stored. FIG. 2A shows a state in which the shutter is locked, and FIG. 2B shows a state in which the shutter is not locked. The shutter 6 is located between the rolled paper 2 and the magenta fixing lamps 4 or the yellow fixing lamps 5. When the shutter is located at the position where it covers the entire upper surface of the reflector 5*a* in which the yellow fixing lamps 5 are stored as shown in FIG. 1A and FIG. 2A, the distal end thereof abuts against first stoppers 21*a*, 21*b* provided on the main body, so that the movement thereof toward the sheet-discharging side (right side in the drawing) is limited. When the shutter is located at the position where it covers the entire upper surface of the reflector 4*a* in which the magenta fixing lamps 4 are stored as shown in FIG. 1B and FIG. 2B, the rear end thereof abuts against second stoppers 22*a*, 22*b* provided on the main body, and the movement thereof toward the rolled paper 2 side (left side on the drawing) is limited. In other words, the range of the movement of the shutter 6 is limited by the first stoppers 21*a*, 21*b* and the second stoppers 22*a*, 22*b*. The shutter 6 moves between the position shown in FIG. 2A and the position shown in FIG. 2B. The shutter 6 is formed with a rack gear 6*a* on the upper surface thereof. The rack gear 6*a* is connected to a gear for transmitting the drive force of the feeding motor which feeds the rolled paper 2.

Reference numeral 7 designates a locking member for restricting the movement of the shutter 6 which abuts against the first stoppers 21*a*, 21*b* at the distal end thereof from moving toward the rolled paper 2. The locking member 7 is mounted so as to be capable of rotating about the axis of fulcrum 7*a*. Reference numeral 8 designates a third stopper for limiting the rotation of the locking member 7. The locking member 7 abuts the rear end of the shutter 6 at the distal end thereof, which is bent as shown in the drawing, and restricts the shutter 6 from moving toward the rolled paper 2 when in the locking state (the state shown in FIG. 2A). When it is in the unlocking state (the state in FIG. 2B), the shutter 6 does not abut against the locking member 7, and the movement of the shutter 6 is not restricted. In this manner, the locking member 7 is switched to the locking state or to the unlocking state by being rotated. Reference numeral 9 designates a base to which a cutting edge for cutting the rolled paper 2 is mounted. The base 9 is mounted so as to be capable of moving in the direction vertical to the plane of the paper in FIGS. 1A and 1B. The locking member 7 is switched between the locking state in which the movement of the shutter 6 is restricted, and the unlocking state in which the movement thereof in not restricted by the movement of the base 9. The base 9 is moved by a motor, not shown.

Figure 3A:
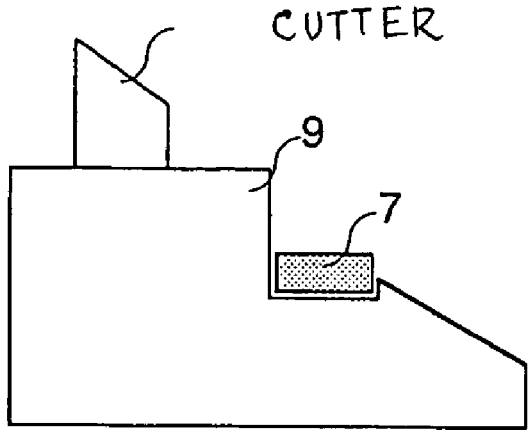
FIGS. 3A, 3B, and 3C shows a base on which a cutting edge for cutting a rolled paper is mounted.
Figure 3B:
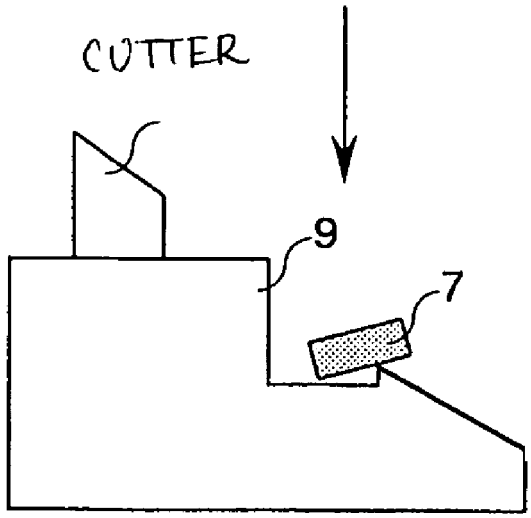
Figure 3C:
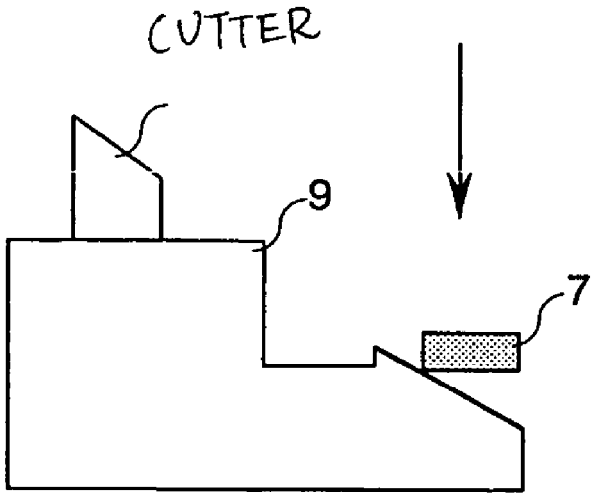

FIG. 3A, 3B, and 3C show an enlarged view of the base 9. The base 9 is formed with a relatively gentle bevel on one side (right side in the drawing) as shown in FIGS. 3A, 3B, and 3C, and a recess in which the rear end of the locking member 7 engages is formed continuously from the bevel. The state shown in FIG. 2A is a state in which the rear end of the locking member 7 engages the recess of the base 9 (See FIG. 3A). The position of the base 9 of this time is referred to as a locked position.

The recess is lower on the side of the bevel and higher on the opposite side, as shown in the drawing. The left side in FIGS. 3A, 3B, and 3C corresponds to the upper side in FIGS. 2A, 2B, and 2C. Even when a drive force in the direction of moving the shutter 6 toward the reflector 5*a* is exerted on the shutter 6 in this state, since the rear end of the locking member 7 is engaged the recess on the base 9 and hence the locking member 7 does not rotate. Therefore, the movement of the shutter 6 is restricted.

When the base 9 moves from the locked position leftward in FIGS. 3A, 3B, and 3C (upward in FIGS. 2A, 2B, and 2C), the locking member 7 rotates about the fulcrum 7*a* in association with the movement of the base 9. When the base 9 is further moved, the rear end of the locking member 7 is disengaged from the recess on the base 9 (FIGS. 3B, 3C). The locking member 7, which is rotated by the movement of the base 9, abuts against the third stopper 8 and stops. This state corresponds to the state shown in FIG. 2B. In this state, the shutter 6 does not abut against the locking member 7 and hence the movement thereof is not restricted.

When the base 9 is returned to the locked position, the movement in reverse order occurs, and the rear end of the locking member 7 engages the recess of the base 9, so that the shutter 6 is retrained from moving toward the rolled paper 2 by the locking member 7. At this time, since the rear end of the locking member 7 engages the recess along the bevel on the base 9, and the movement is achieved smoothly.

The position of the base 9 shown in FIG. 2B corresponds the position where the cutting edge which is mounted to the base 9 does not abut against the rolled paper 2, and hence the rolled paper is not cut. This position is defined to be the initial position of the base 9.

The specific position in the invention is the above-described locked position.

Referring back to FIGS. 1A and 1B, reference numeral 11 designates a feed roller for feeding the rolled paper 2, and is driven by the feed motor, not shown. Reference numerals 12 to 16 designate a gear group for transmitting the drive force of the feed motor and moving the shutter 6. The gear 16 engages a rack gear 6*a* provided on the upper surface of the shutter 6. Reference numerals 17 and 18 designate sheet discharging rollers.

Although it is omitted in the above-described description, a plurality of feed rollers for guiding the rolled paper 2 to the sheet discharging rollers 17, 18 are provided on the feed path of the rolled paper 2.

Figure 4A:
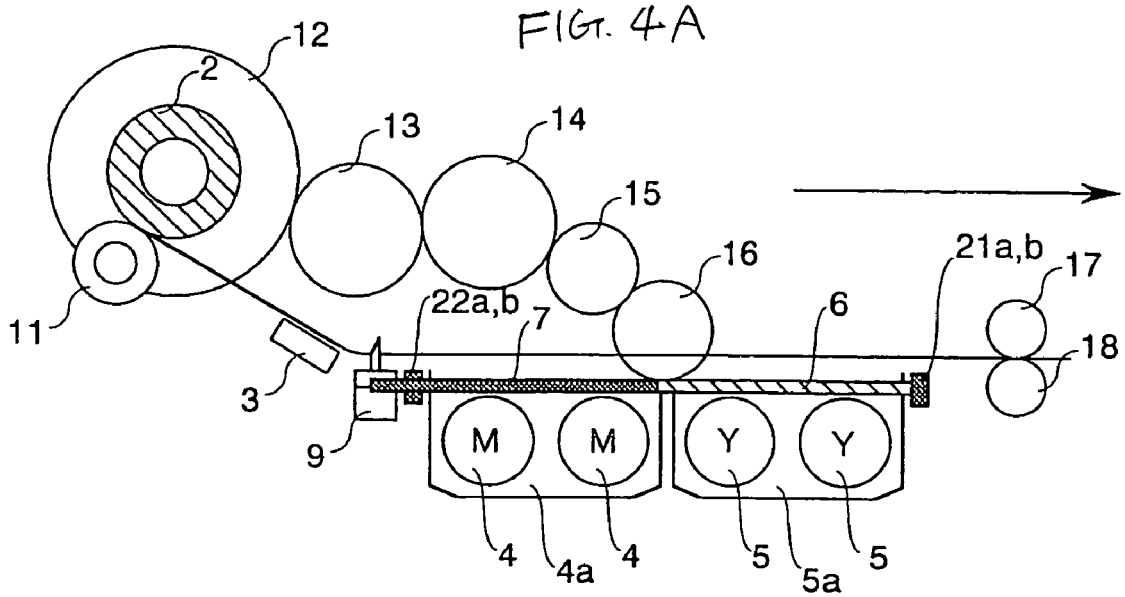
FIGS. 4A, 4B, and 4C shows an operation of the photo printer according to the embodiment of the present invention.

Subsequently, a color image forming process in the photo printer 1 according to the present embodiment will be described. The photo printer 1 first moves the position of the base 9 to the initial position shown in FIG. 2B. In this state, the yellow fixing lamps 5 and the magenta fixing lamps 4 are OFF. The photo printer 1 drives the feed motor, and feeds the rolled paper 2. At this time, the movement of the shutter 6 is not restricted by the locking member 7 (in the unlocked state) The shutter 6 moves toward the sheet discharging rollers 17, 18 by the drive force of the feed motor transmitted via the gear group 12–16, and when the distal end thereof abuts against the first stoppers 21*a*, 21*b*, it stop at this position. The photo printer 1 stops the feed motor when the rolled paper 2 is fed to the side of the sheet discharging rollers 17, 18 with respect to the thermal head 3 by the amount exceeding the size of the image which is to be formed this time (See FIG. 4A).

Figure 4B:
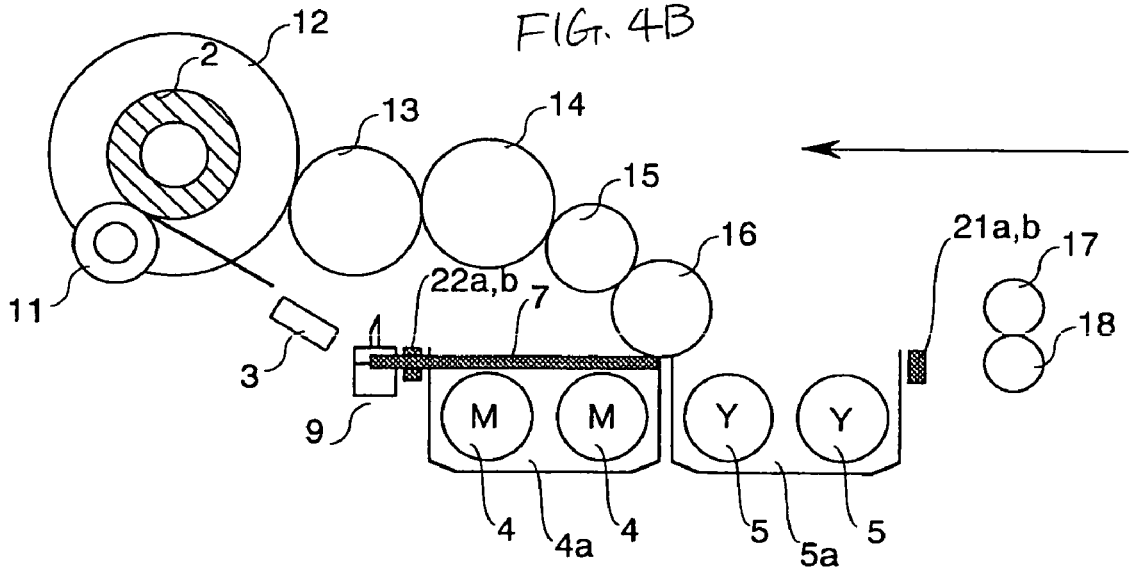

Subsequently, the photo printer 1 rotates the feed motor in the reverse direction, and forms an image on the heat-sensitive yellow color developing layer by the thermal head 3 while retracting the rolled paper 2 which is fed. At this time, the shutter 6 is retracted toward the rolled paper 2 by the drive force of the feed motor transmitted via the gear group 12–16, abuts against the second stoppers 22*a*, 22*b* at the rear end, and stops. The photo printer 1 stops the feed motor upon completion of image formation on the heat-sensitive yellow color developing layer (see FIG. 4B).

Figure 4C:
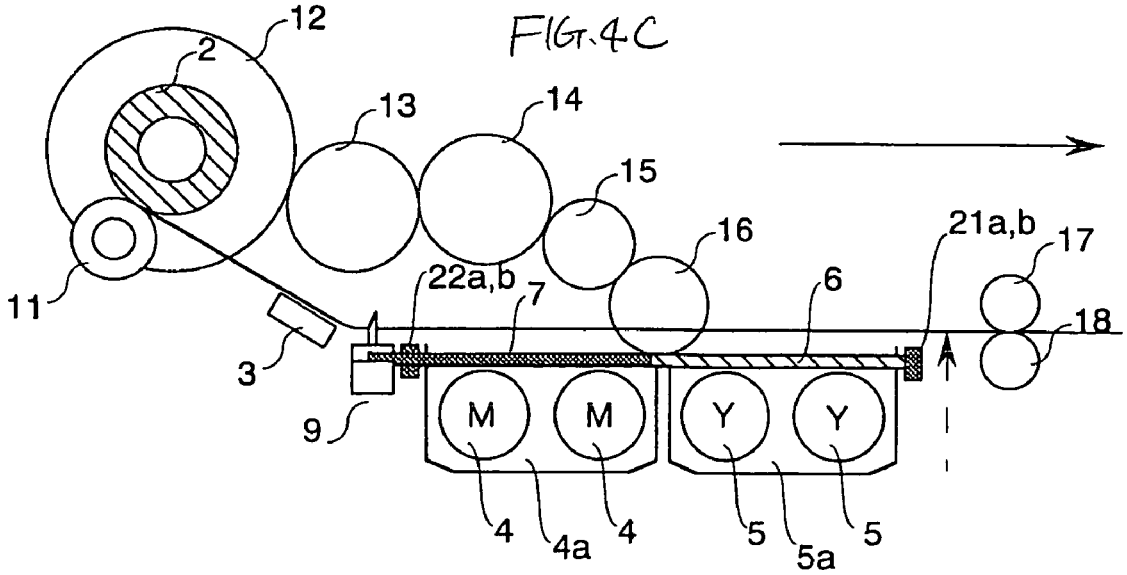

Then, the feed motor is driven in the direction of feeding the rolled paper 2. At this time, the drive force of the feed motor is transmitted to the shutter 6 via the gear group 12–16 and the shutter 6 moves toward the sheet discharging side. Then the shutter 6 abuts against the first stoppers 21*a*, 21*b* at the distal end thereof and stops. The photo printer 1 stops the feed motor when the rear end of the image forming area on which the image is formed this time is located on the side of the sheet discharging rollers 17, 18 by a predetermined amount with respect to the distal end of the shutter 6, which is stopped by being abutted against the first stoppers 21*a*, 21*b* (See FIG. 4C).

Here, the photo printer 1 moves the base 9 from the initial position to the locked position. Accordingly, the locking member 7 abuts against the rear end of the shutter 6 at the distal end thereof, and is brought into the locked state in which the movement of the shutter 6 is restricted (the state shown in FIG. 2A). The photo printer 1 turns the yellow fixing lamps 5 on, and retracts the rolled paper 2 by rotating the feed motor in the reverse direction thereafter. At this time, although the drive force to retract the shutter 6 toward the rolled paper 2 is transmitted to the shutter 6 via the gear group 12–16, since the movement thereof is restricted by the locking member 7, it is not moved.

Figure 5A:
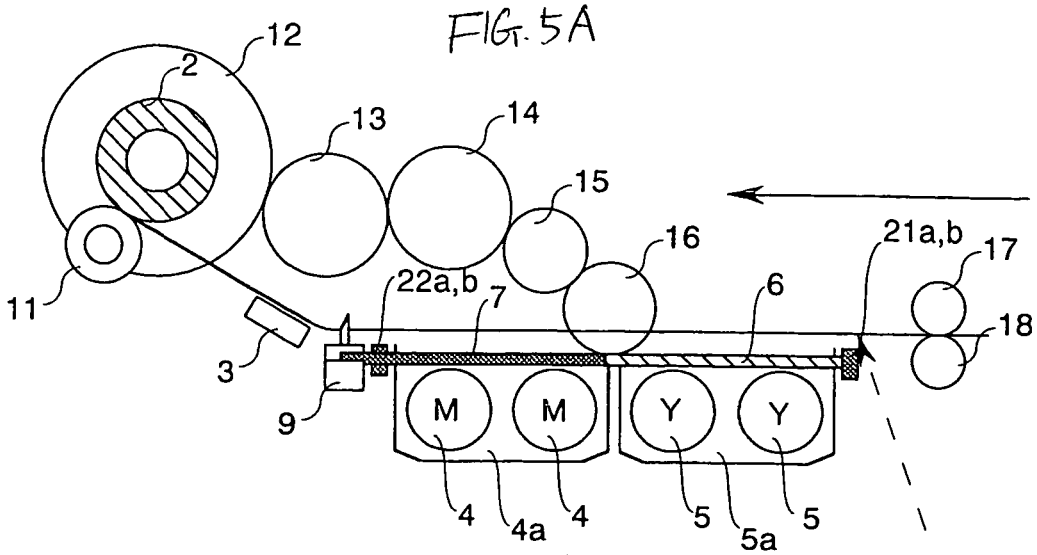
FIGS. 5A, 5B, and 5C show an operation of the photo printer according to an embodiment of the present invention.

When the rear end of the image forming area of this time is retracted to the position in the vicinity of the distal end of the shutter 6 (See FIG. 5A), the photo printer 1 moves the base 9 from the locked position to the initial position, and switches into the unlocked state in which the locking member 7 does not restrict the movement of the shutter 6 (the state shown in FIG. 2B). In this state, the rolled paper 2 is not cut by the cutting edge mounted to the base 9. In other words, when the base 9 is at the initial position, the cutting edge provided on the base 9 does not abut against the rolled paper 2.

Figure 5B:
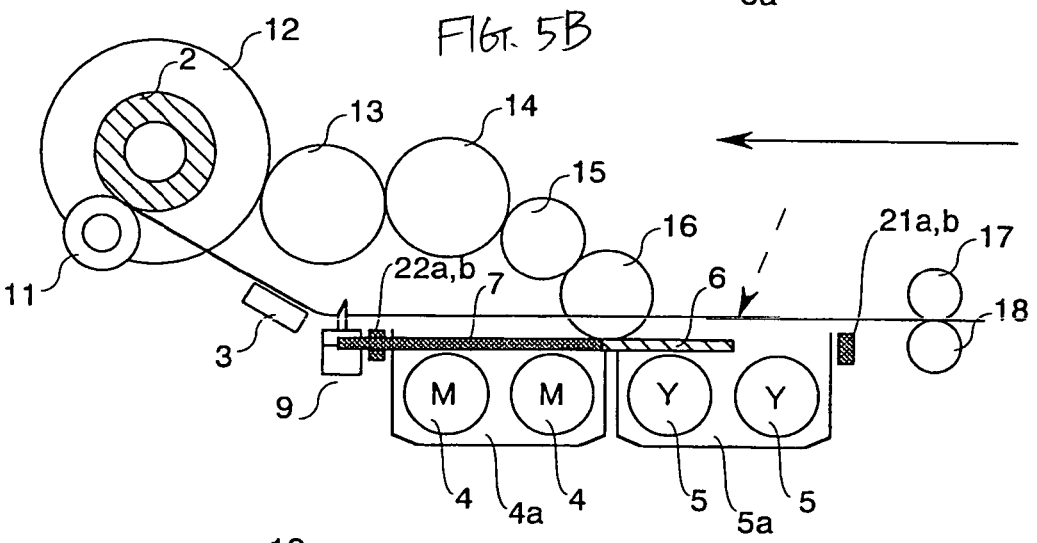

The shutter 6, which is in the unlocked state, moves toward the rolled paper 2. The gear ratio of the gear group 12–16 is determined so that the speed of movement of the shutter 6 is equalized to the feeding speed of the rolled paper 2. In the photo printer 1, retraction of the rolled paper 2 is continuously carried on. Accordingly, the shutter 6 positioned upwardly of the reflector 5*a* is retracted toward the rolled paper 2, and the image forming area positioned upward thereof is exposed by the yellow fixing lamp 5 which is turned on (See FIG. 5B). The no image forming area is not exposed since the shutter 6 is located downwardly thereof.

Figure 5C:
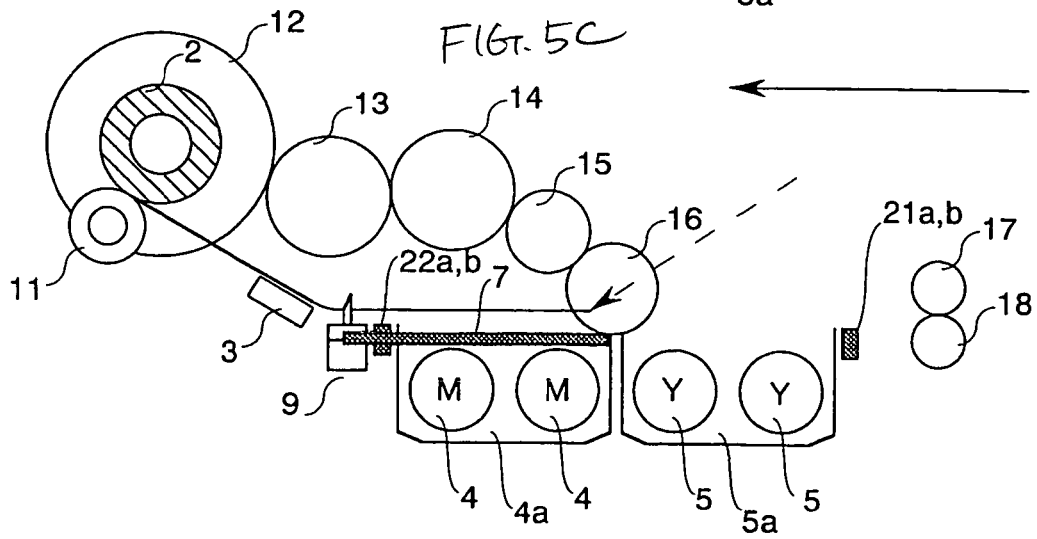

Subsequently, the shutter 6 abuts against the second stoppers 22*a*, 22*b* at the rear end thereof and stops. The photo printer 1 continues retraction of the rolled paper 2 after the shutter 6 is stopped as well, and exposes the entire image forming area of this time by the yellow fixing lamps 5. When the distal end of the image forming area of this time abuts against the second stoppers 22*a*, 22*b* and positioned on the side of the rolled paper 2 with respect to the distal end of the shutter 6, the photo printer 1 stops the feed motor (See FIG. 5C). At this moment, the yellow fixing lamps 5 are turned off.

Figure 6A:
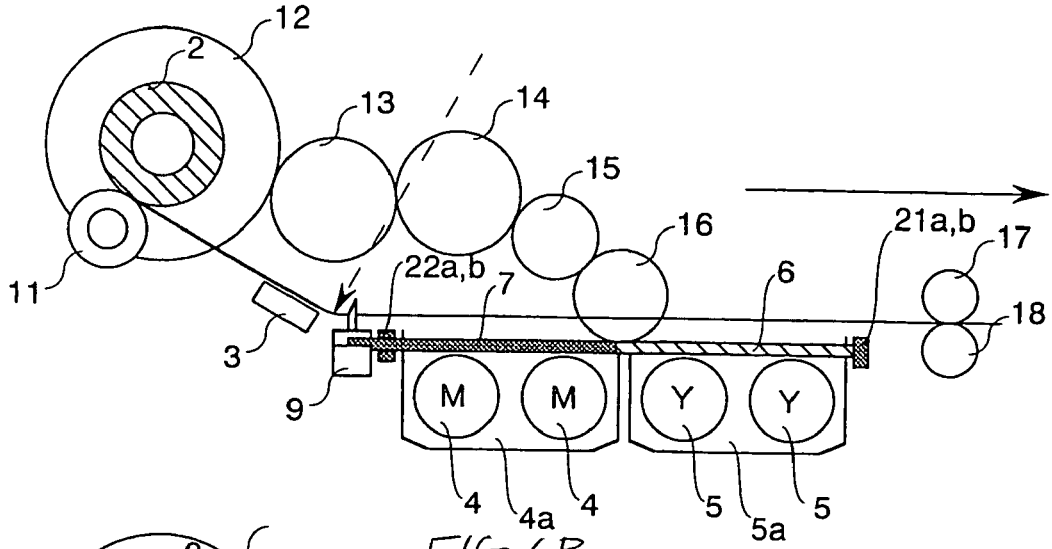
FIGS. 6A, 6B, and 6C show an operation of the photo printer according to the embodiment of the present invention.

Subsequently, the photo printer 1 forms an image on the heat-sensitive magenta color on the rolled paper 2. The photo printer 1 first drives the feed motor and feeds the rolled paper 2. The shutter 6 is not locked by the locking member 7. The drive force of the feed motor is transmitted to the shutter 6 via the gear group 12–16, and the shutter 6 moves toward the sheet discharging rollers 17, 18. Then, the shutter 6 abuts against the first stoppers 21*a*, 21*b* at the distal end thereof, and stops. When the rear end of the image forming area on which the image was formed on the heat-sensitive yellow color developing layer is located on the side of the sheet discharging rollers 17, 18 with respect to the thermal head 3, the photo printer 1 stops the feed motor (See FIG. 6A).

Figure 6B:
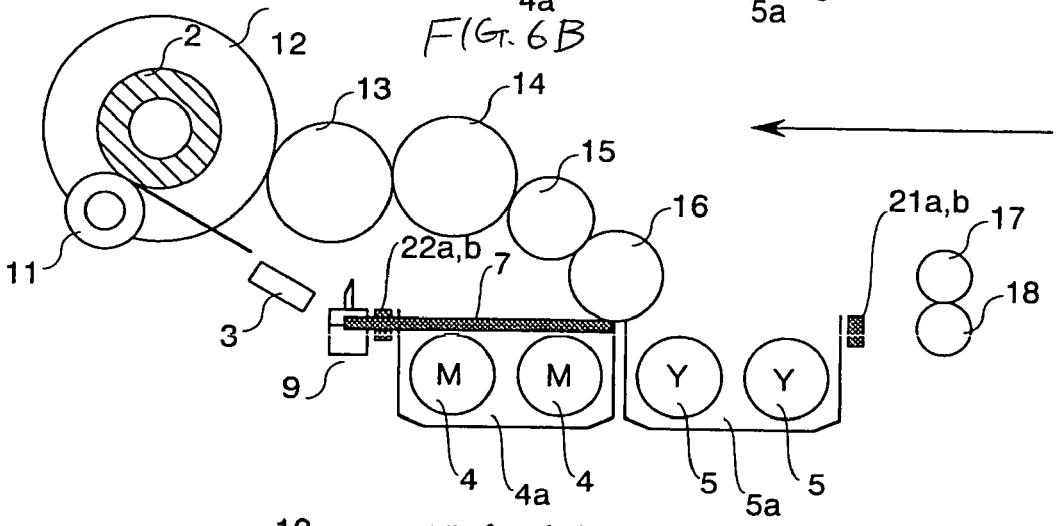

Subsequently, the photo printer 1 rotates the feed motor in the reverse direction, and forms an image on the heat-sensitive magenta color developing layer by the thermal head 3 while retracting the rolled paper 2 which is fed. In this state, the shutter 6 is retracted toward the rolled paper 2 by the drive force of the feed motor transmitted via the gear group 12–16, abuts against the second stoppers 22*a*, 22*b* at the rear end thereof, and stops. The photo printer 1 stops the feed motor upon completion of formation of the image on the heat-sensitive magenta color developing layer (See FIG. 6B). Then, the magenta fixing lamps 4 are turned on.

Figure 6C:
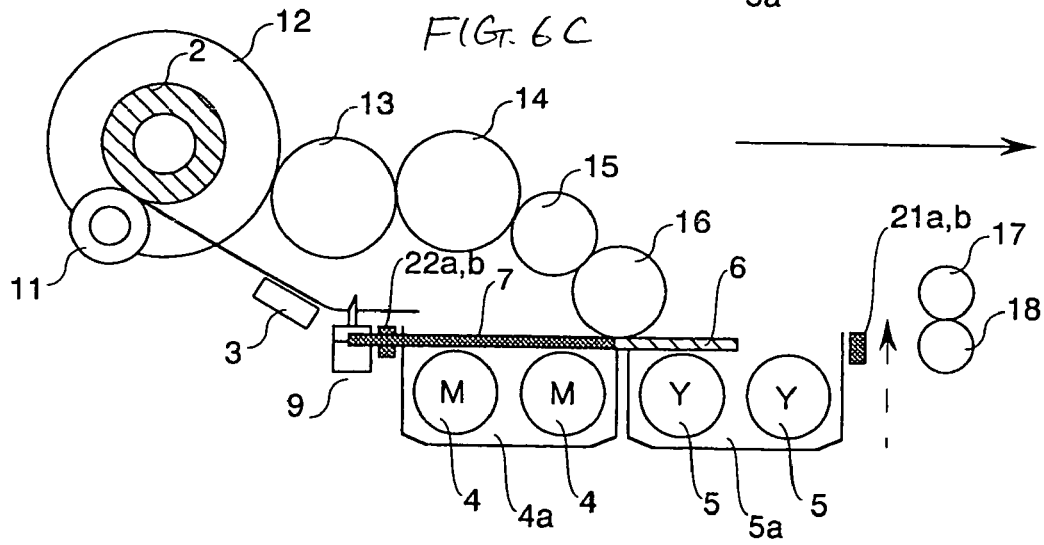

Subsequently, the photo printer 1 drives the feed motor in the direction of feeding the rolled paper 2. In this state, the drive force of the feed motor is transmitted to the shutter 6 via the gear group 12–16, and the shutter 6 moves toward the sheet discharging rollers 17, 18. When the distal end of the image forming area of this time is positioned above the reflector 5*a*, that is, when the distal end of the image forming area of this time reaches the exposing area of the magenta fixing lamps 4, the shutter 6 is not located under the distal end of the image forming area of this time, and hence the image forming area of this time is exposed by the magenta fixing lamps 4 (See FIG. 6C).

Figure 7A:
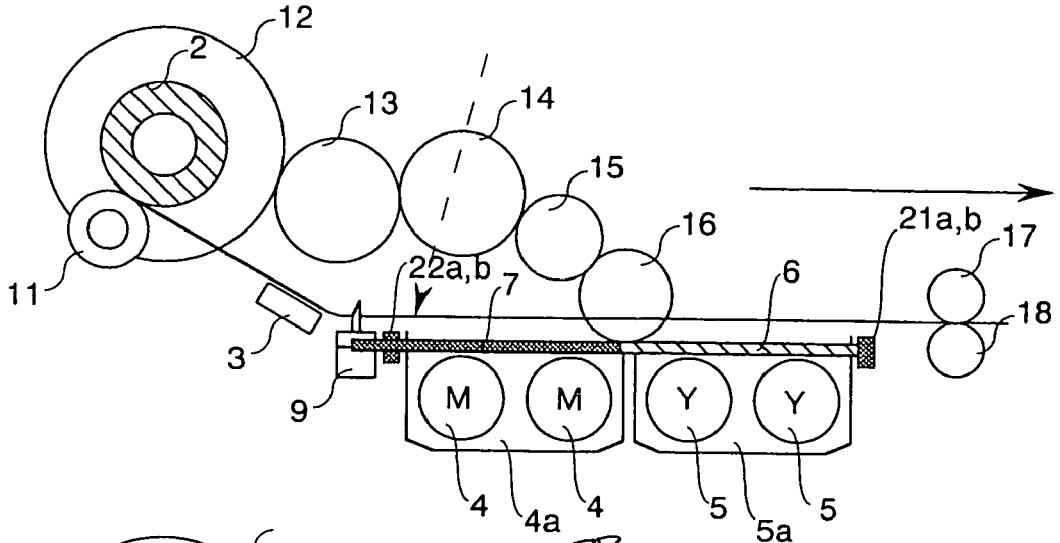
FIGS. 7A, 7B, and 7*c* show an operation of the photo printer according to the embodiment of the present invention.

Subsequently, the shutter 6 abuts against the first stoppers 21*a*, 21*b* at the distal end thereof, and stops. When the rear end of the image forming area of this time reaches the exposing area of the magenta fixing lamps 4 (See FIG. 7A), the photo printer 1 stops the feed motor and turns the magenta fixing lamps 4 off.

In this manner, when the rear end of the image forming area on which the image is formed this time reaches the exposing area of the magenta fixing lamps 4, the photo printer 1 stops feeding of the rolled paper 2, and hence the no image forming area on which no image is formed this time is hardly exposed.

Figure 7B:
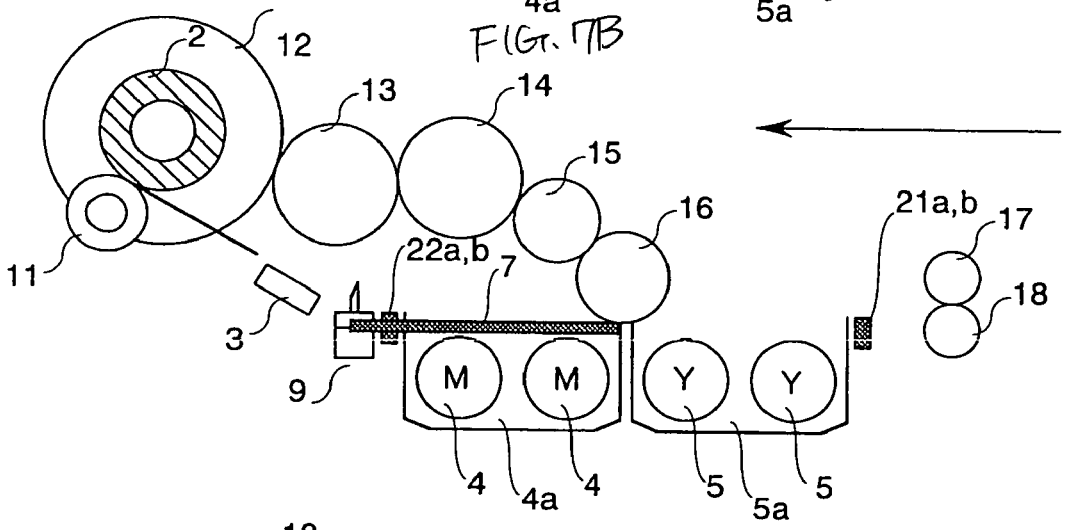

Then, the photo printer 1 rotates the feed motor in the reverse direction and forms an image on the heat-sensitive cyan color developing layer by the thermal head 3 while retracting the rolled paper 2. In this state, the shutter 6 is retracted toward the rolled paper 2 by the drive force of the feed motor transmitted via the gear group 12–16, abuts against the second stoppers 22*a*, 22*b* at the rear end thereof, and stops. The photo printer 1 stops the feed motor upon completion of image formation on the heat-sensitive magenta color developing layer (See FIG. 7B).

Figure 7C:
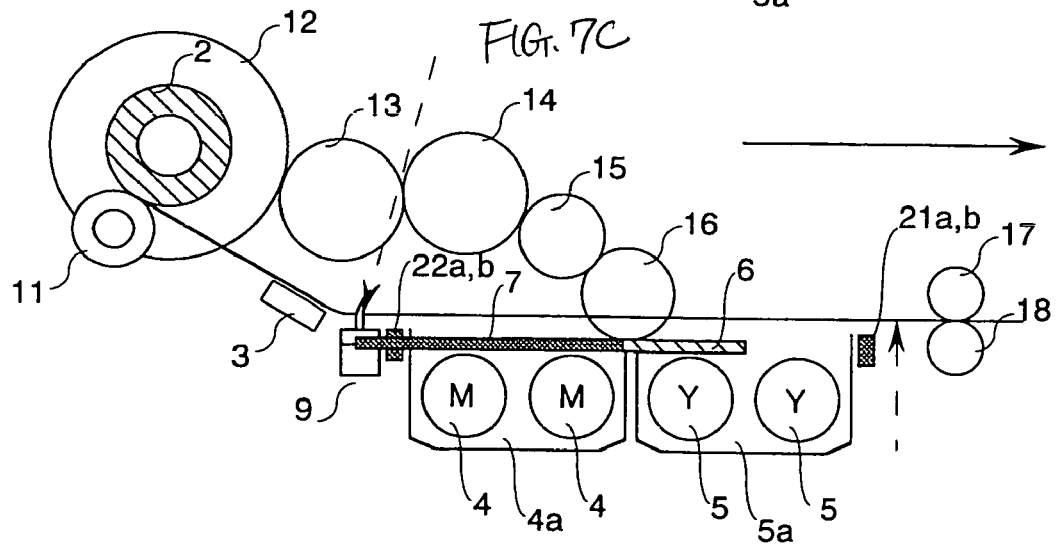

The photo printer 1 drives the feed motor in the direction of feeding the rolled paper 2. In this state, the drive force of the feed motor is transmitted to the shutter 6 via the gear group 12–16, and the shutter 6 moves toward the sheet discharging rollers 17, 18. When the rear end of the image forming area of this time reaches the cutting position to be cut by the cutting edge mounted to the base 9, the photo printer 1 stops the feed motor, moves the base 9 widthwise of the rolled paper 2 and cut the image forming area of this time off the rolled paper 2 (See FIG. 7C). The photo printer 1 discharges the rolled paper 2 which is cut off, in other words, the sheet on which the color image is formed this time, and terminates the procedure.

In this manner, since the photo printer 1 according to the present embodiment is configured to move the shutter 6 by the drive force of the feed motor for feeding the rolled paper 2 and synchronize the movements of the rolled paper 2 and the shutter 6 at the moment of fixing the yellow image by the locking member 7 which restrict the movement of the shutter 6, it is not necessary to provide an electromagnetic clutch on the gear group 12–16 for transmitting the drive force of the feed motor to the shutter 6. Accordingly, the structure of the gear group 12–16 may be simplified, and the number of steps of assembly can be reduced, whereby the cost of the main body may be reduced.

Also, since switching between the locked state in which the movement of the shutter 6 is restricted by the locking member 7 and the unlocked state in which the movement thereof is not restricted can be achieved by the existing structure for cutting the rolled paper 2, the cost of the main body may further be reduced.

Accordingly, according to the present invention, the movement of the rolled paper at the time of fixing the yellow image can be synchronized with the movement of the shutter with a simple structure, and hence cost reduction of the main body is achieved.

since switching between the locked state in which the movement of the shutter is restricted and the unlocked state in which the movement thereof is not restricted can be achieved by the existing structure for cutting the rolled paper, the cost of the main body may further be reduced.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A photo printer comprising:

feeding means for feeding a rolled paper on which heat-sensitive color developing layers for yellow, magenta, and cyan are formed by a feeding motor;

a thermal head changing a heat-sensitive temperature for each of the heat-sensitive color developing layers of the rolled paper which is fed by the feeding means, performing heat-sensitive recording and forming an image;

a magenta fixing lamp for fixing an image formed by the thermal head on the heat-sensitive magenta color developing layer a yellow fixing lamp for fixing an image formed by the thermal head on the heat-sensitive yellow color developing layer;

wherein the thermal head, the magenta fixing lamp, the yellow fixing lamp being disposed in order in the rolled paper discharging direction, a shutter movably disposed between the yellow and magenta fixing lamps and the rolled paper and limiting an area of the rolled paper to be exposed; and shutter moving means for transmitting a drive force of the feeding motor to the shutter and moving the shutter in the same direction as a feeding direction of the rolled paper; wherein while the shutter is positioned above the yellow fixing lamp in fixing the image formed on the heat-sensitive yellow color developing layer, the shutter moves together with the rolled paper in case that the rolled paper is retracted to a main body of the photo printer and a rear end of an image forming area of this time is positioned in the vicinity of the distal end of the shutter, movement locking means for restricting the shutter from moving when the drive force to move the shutter in a direction from the yellow fixing lamp toward the magenta fixing lamp is transmitted to the shutter by the shutter moving means in a first state in which the shutter is positioned above the yellow fixing lamp; and cutting means disposed between the thermal head and the magenta fixing lamp for moving a cutting edge of a cutter widthwise of the rolled paper to cut the rolled paper; and a stopper for limiting the range of movement of the shutter, wherein the movement locking means switched into the locking state in which the movement of the shutter is restricted when the position of the cutting edge of the cutting means is at a specific position, and switched into the unlocking state when the cutting edge is other positions.

2. A photo printer comprising:

feeding means for feeding a rolled paper on which heat-sensitive color developing layers for yellow, magenta, and cyan are formed by a feeding motor;

a thermal head changing a heat-sensitive temperature for each of the heat-sensitive color developing layers of the rolled paper which is fed by the feeding means, performing heat-sensitive recording and forming an image;

a magenta fixing lamp for fixing an image formed by the thermal head on the heat-sensitive magenta color developing layer a yellow fixing lamp for fixing an image formed by the thermal head on the heat-sensitive yellow color developing layer;

wherein the thermal head, the magenta fixing lamp, the yellow fixing lamp being disposed in order in the rolled paper discharging direction, a shutter movably disposed between the yellow and magenta fixing lamps and the rolled paper and limiting an area of the rolled paper to be exposed; and a shutter moving means for transmitting a drive force of the feeding motor to the shutter and moving the shutter in the same direction as a feeding direction of the rolled paper; wherein while the shutter is positioned above the yellow fixing lamp in fixing the image formed on the heat-sensitive yellow color developing layer, the shutter moves together with the rolled paper in case that the rolled paper is retracted to a main body of the photo printer and a rear end of an image forming area of this time is positioned in the vicinity of the distal end of the shutter, and movement locking means for restricting the shutter from moving when the drive force to move the shutter in a direction from the yellow fixing lamp toward the magenta fixing lamp is transmitted to the shutter by the shutter moving means in a first state in which the shutter is positioned above the yellow fixing lamp.

3. The photo printer according to claim 2, wherein the photo printer further includes cutting means disposed between the thermal head and the magenta fixing lamp for moving a cutting edge of a cutter widthwise of the rolled paper to cut the rolled paper, and the movement locking means is switched into the locking state in which the movement of the shutter is restricted when the position of the cutting edge of the cutting means is at a specific position, and switched into the unlocking state when the cutting edge is other positions.

4. The photo printer according to claim 2, wherein the photo printer further includes a stopper for limiting the range of movement of the shutter.

5. A photo printer comprising:

a feeding device feeding a rolled paper on which heat-sensitive color developing layers for yellow, magenta, and cyan are formed by a feeding motor;

a thermal head changing a heat-sensitive temperature for each of the heat-sensitive color developing layers of the rolled paper which is fed by the feeding devive, performing heat-sensitive recording and forming an image;

a magenta fixing lamp fixing an image formed by the thermal head on the heat-sensitive magenta color developing layer an yellow fixing lamp fixing an image formed by the thermal head on the heat-sensitive yellow color developing layer;

wherein the thermal head, the magenta fixing lamp, the yellow fixing lamp being disposed in order in the rolled paper discharging direction, a shutter movably disposed between the yellow and magenta fixing lamps and the rolled paper and limiting an area of the rolled paper to be exposed; and a shutter moving devive transmitting a drive force of the feeding motor to the shutter and moving the shutter in the same direction as a feeding direction of the rolled paper; wherein while the shutter is positioned above the yellow fixing lamp in fixing the image formed on the heat-sensitive yellow color developing layer, the shutter moves together with the rolled paper in case that the rolled paper is retracted to a main body of the photo printer and a rear end of an image forming area of this time is positioned in the vicinity of the distal end of the shutter, a movement locking device restricting the shutter from moving when the drive force to move the shutter in a direction from the yellow fixing lamp toward the magenta fixing lamp is transmitted to the shutter by the shutter moving device in a first state in which the shutter is positioned above the yellow fixing lamp; and a cutting device disposed between the thermal head and the magenta fixing lamp for moving a cutting edge of a cutter widthwise of the rolled paper to cut the rolled paper; and a stopper limiting the range of movement of the shutter, wherein the movement locking device switched into the locking state in which the movement of the shutter is restricted when the position of the cutting edge of the cutting device is at a specific position, and switched into the unlocking state when the cutting edge is other positions.

* * * * *